United States Patent [19]

Coffee et al.

[11] Patent Number: 4,846,407

[45] Date of Patent: Jul. 11, 1989

[54] ELECTROSTATIC SPRAYING APPARATUS

[75] Inventors: Ronald A. Coffee, Haslemere; Timothy J. Noakes, Selbourne, near Alton; Stephen J. Bancroft, Haslemere; Edward J. Bals, Bromyard, all of England

[73] Assignee: Imperial Chemical Industries plc, London, England

[21] Appl. No.: 40,666

[22] Filed: Apr. 21, 1987

[30] Foreign Application Priority Data

Apr. 21, 1986 [GB] United Kingdom ..... 8609703

[51] Int. Cl.[4] ..... B05B 5/02

[52] U.S. Cl. ..... 239/690

[58] Field of Search ..... 361/225, 228, 230, 233; 239/690, 690.1, 695, 696, 697, 700, 703, 239

[56] References Cited

U.S. PATENT DOCUMENTS

| | | | |
|---|---|---|---|
| 2,695,002 | 11/1954 | Miller | 239/263.1 X |
| 2,718,477 | 9/1955 | Miller | 239/690 X |
| 2,723,646 | 11/1955 | Ransburg | 239/690 X |
| 2,955,565 | 10/1960 | Schotland | 239/703 X |
| 3,248,606 | 4/1966 | Fraser | 239/697 X |
| 3,682,384 | 8/1972 | Suisse | 239/697 |
| 4,381,533 | 4/1983 | Coffee | 239/696 X |
| 4,421,281 | 12/1983 | Coffee et al. | 239/690 |
| 4,519,549 | 5/1985 | Yokoe et al. | 239/700 X |

FOREIGN PATENT DOCUMENTS

| | | | |
|---|---|---|---|
| 216502 | 4/1987 | European Pat. Off. | 239/697 |
| 1075992 | 2/1960 | Fed. Rep. of Germany | 239/690 |
| 1569707 | 6/1980 | Fed. Rep. of Germany | 239/690 |
| 60-51858 | 3/1985 | Japan . | |
| 1005621 | 9/1965 | United Kingdom . | |
| 1281512 | 7/1972 | United Kingdom . | |
| 1581192 | 12/1980 | United Kingdom . | |

*Primary Examiner*—Andres Kashnikow
*Assistant Examiner*—Kevin P. Weldon
*Attorney, Agent, or Firm*—Cushman, Darby & Cushman

[57] ABSTRACT

An electrostatic spraying apparatus for spraying liquid has a spraying edge 8 provided with teeth 12. No parts of the apparatus provide a low potential influence near the spraying edge, keeping leakage losses to a minimum. At the voltage provided by a high voltage supply, the field strength at the tips of the teeth 12, is sufficient to form one ligament of liquid per tooth. The ligaments break up into droplets which have a size largely independent of fluctuations in field strength caused by varying the distance from the target to be sprayed.

6 Claims, 4 Drawing Sheets

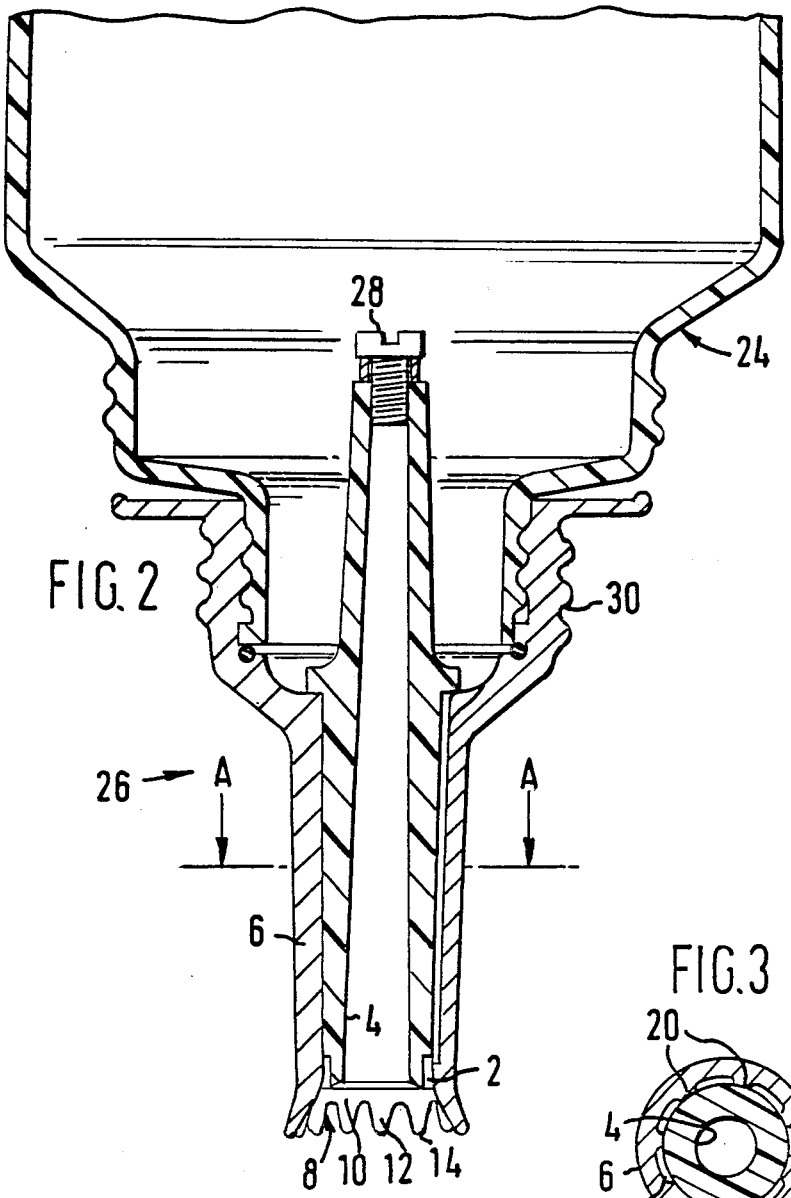
FIG. 2
FIG. 3
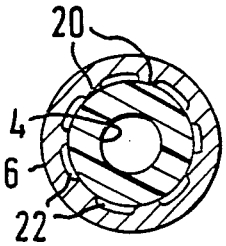

FIG.4
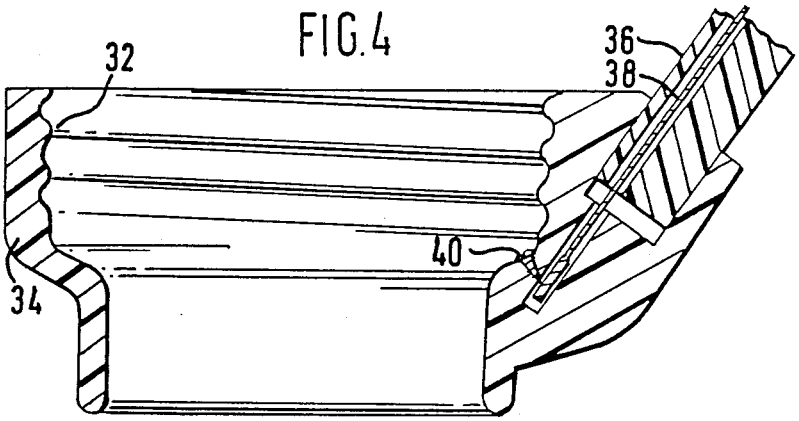
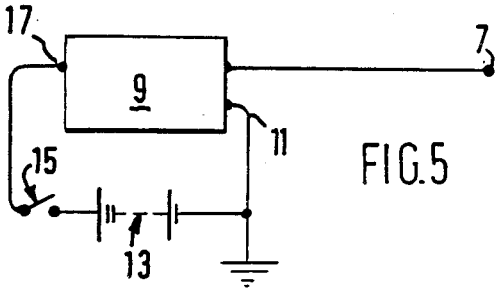
FIG.5
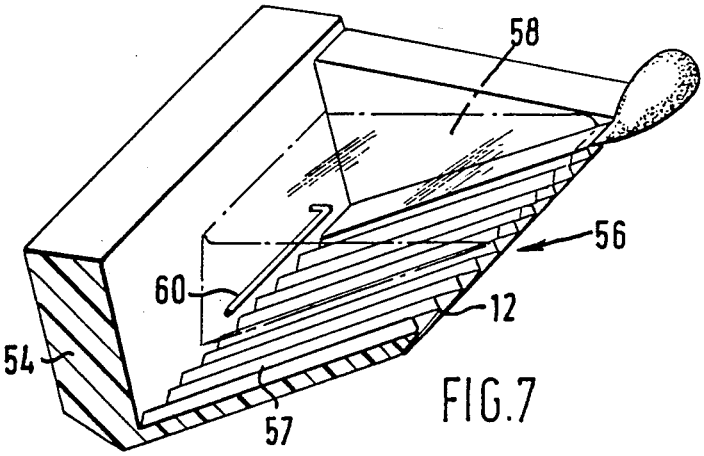
FIG.7

ELECTROSTATIC SPRAYING APPARATUS

FIELD OF THE INVENTION

This invention relates to apparatus for electrostatic spraying.

BACKGROUND OF THE INVENTION

Many liquids are or can be sprayed electrostatically. Some particular examples are pesticides or other agricultural chemicals, paints, lacquers, adhesives, release agents, and so on. One feature of electrostatic spraying which is usually of advantage, is that because the droplets in the spray carry an electrostatic charge, they tend to deposit more reliably on the target. Less of the liquid being sprayed is wasted.

Electrostatic spraying apparatus is known in which liquid is drawn out preponderantly by electrostatic forces into ligaments which break up into electrically charged droplets. In order for that to happen the electric field strength must be sufficiently high. In order to reduce the voltage required to produce a sufficient field strength, it is known to supply the liquid to a sharp edge, the shape of which intensifies the electric field, and from which the liquid sprays.

In the prior art, when a plurality of ligaments is produced from one edge, at any given flow rate the number of ligaments which form depends on the field strength at the edge. Increasing the field strength increases the number of ligaments. Increasing the number of ligaments at the same overall flow rate, has the effect that each ligament is finer so that the droplets it breaks up into, are smaller. Thus increasing the electric field strength at the edge, reduces the droplet size.

Unfortunately, the field strength at the edge depends on the distance between the edge and the earth boundary of the electric field. The effective earth boundary is the target. Thus the droplet size depends very significantly on the distance from the target. When the distance from the target increases, the droplet size increases. A technique for producing an intense electric field which overcomes this problem, is described in British Pat. No. 1569707. Here the electric field is defined between a spraying edge and an earthed electrode, usually referred to as a field adjusting electrode (FAE), adjacent the edge. Because the electrode is so much nearer the edge than the target, the electric field strength at the edge is largely independent of the distance from the target. Thus, provided other parameters such as flow rate and voltage are controlled, the droplet size is very largely independent of the distance from the target.

An interesting feature of this apparatus is that the electrode can be positioned so that virtually none of the droplets produced deposit on the electrode.

Further, since the field strength can be accurately defined, it is possible to balance the voltage and the position of the electrode so that in use the field strength is insufficient to produce a corona discharge. That enables an apparatus to be powered by torch batteries and thus to be portable, which had not been possible previously since corona discharge had previously led to a rather heavy current requirement.

A significant part of the cost of the apparatus is the cost of the high voltage generator. One possibility for reducing the cost of the generator, would be to allow greater tolerance in its output voltage by finding another mechanism for controlling droplet size.

Another possibility for reducing the cost of the generator is to reduce the current flow still further. It is now speculated that the nearness of the electrode to the edge may cause a significant leakage via the materials of the apparatus, in use, even though that is much smaller than had previously been produced by corona.

A means of controlling droplet size is therefore sought which does not require a closely regulated voltage output and which does not introduce as short a potential leakage path.

SUMMARY OF THE INVENTION

In accordance with the invention there is provided electrostatic spraying apparatus, comprising: a nozzle having a spraying edge, an electrically conducting or semiconducting liquid contacting surface and means for delivering liquid to be sprayed to the edge; and high voltage supply means for charging the surface to a high potential, characterised by the edge being so shaped at a plurality of sites that, in use, when covered by the liquid to be sprayed, the local electric field strength is intensified sufficiently, at the voltage produced by the high voltage supply means, that the liquid at the sites is drawn out preponderantly by electrostatic forces into ligaments which break up into electrically charged particles; the edge between said sites being so shaped that, in use, the local electric field strength is relatively less intense; and the nozzle being so positioned in said apparatus that, in use, the said electric field strength is defined substantially independent of any low potential influences from the apparatus.

The edge may be shaped at the sites to provide teeth for example. A local intensification of the electric field is produced at the tips of the teeth. At the voltage produced by the voltage supply means, the intensification is sufficient to draw out ligaments of the liquid. A ligament is therefore formed at each tip.

The parameters which determine whether or not a ligament is formed per tip include: the voltage produced by the high voltage generator, the distance from the spray head to the target, the sharpness of the tips, the resistivity of the liquid to be sprayed, the number or spacing of the tips, and the flow rate.

With all other parameters constant, we have discovered that there is a lower threshold voltage above which there is a sufficiently intense field in the region of each of the sites, to produce one ligament per site. A wide range of voltages will produce sufficient intensification only at the tips, so that one ligament is produced per tip, until an upper threshold voltage is reached. At the upper threshold there is sufficient field strength that more than one ligament per tip is produced with the effect that control of the droplet size is lost.

When the distance from the target is varied, the value of the lower threshold voltage changes. As the distance from the target decreases, the lower threshold voltage reduces. As the distance from the target increases, the lower threshold voltage increases.

Surprisingly, provided the spray head is not operated near the lower threshold voltage, it is possible to vary the distance from the target and the voltage to which the surface is charged, quite widely while producing one ligament per tip. If the voltage is too low there would be less than one ligament per tip. If the voltage is too high there would be more than one ligament per tip. However the range of suitable voltages can be quite wide: for example 25 to 35 Kv, which does not place very exacting requirements on the voltage supply means. Preferably, the voltage is substantially higher than the lower threshold.

The droplet size was thus found to be tolerant of a wide range of voltages and largely independent of the distance from the target.

The apparatus has advantages even in cases where it is not so necessary to reduce the cost of the generator. Particularly at higher flow rates, it is difficult to avoid contamination of an FAE. Mere removal of the FAE, however, would loose control of the droplet size. Utilization of the invention enables the control of the droplet size to be retained without the possibility of contaminating an FAE since that is not present. When working close to a target, the spray from a device embodying the invention tends to produce a well defined edge between the area of the target which is sprayed and that which is not. This can be an advantage in some applications and contrasts with what happens when an FAE is provided. The FAE tends to lift the spray cloud away from the target producing a more graded edge to the deposit on the target.

The factors which affect the onset of corona discharge are the sharpness of the tips and the conductivity of the material in which they are formed. The tips may be sharp and formed in material sufficiently insulating to prevent corona discharge, in use, at the voltage produced by the high voltage supply means. The conducting or semiconducting surface is then placed upstream of the edge.

In an alternative, the tips are formed in conducting or semiconducting material. In this case, the tips are made insufficiently sharp to produce corona discharge, in use, at the voltage produced by the high voltage supply means.

Another factor which influences the onset of corona discharge is the presence of the liquid to be sprayed. Provided the tips are not too sharp to be wetted by the liquid, the liquid can be supplied to cover the tips before the high voltage is applied. The covering of liquid increases the corner radius at the boundary of the electric field, which together with the increased resistivity provided by the presence of the liquid, reduces the tendency to corona.

It is expected if the tips are formed in a metal edge, a minimum corner radius at the tip in the region of 100 to 200 microns, would not corona in normal use at a generator voltage of about 30 Kv.

BRIEF DESCRIPTION OF THE DRAWINGS

Embodiments of the invention will now be described, by way of example, with reference to the accompanying drawing, in which:

FIG. 2 shows in more detail, a section through a nozzle and a part of a liquid container assembled therewith, of a second apparatus embodying the invention;

FIG. 3 shows a section on arrows A—A of FIG. 2;

FIG. 4 shows a holder for the nozzle and container of FIGS. 2 and 3;

FIG. 5 shows a battery operated high voltage generator, in a circuit suitable for use with the embodiment of FIG. 1, or of FIGS. 2 to 4;

FIG. 7 is a perspective view, partly in section, of another form of linear nozzle of apparatus embodying the invention.

DETAILED DESCRIPTION

Figure 1:
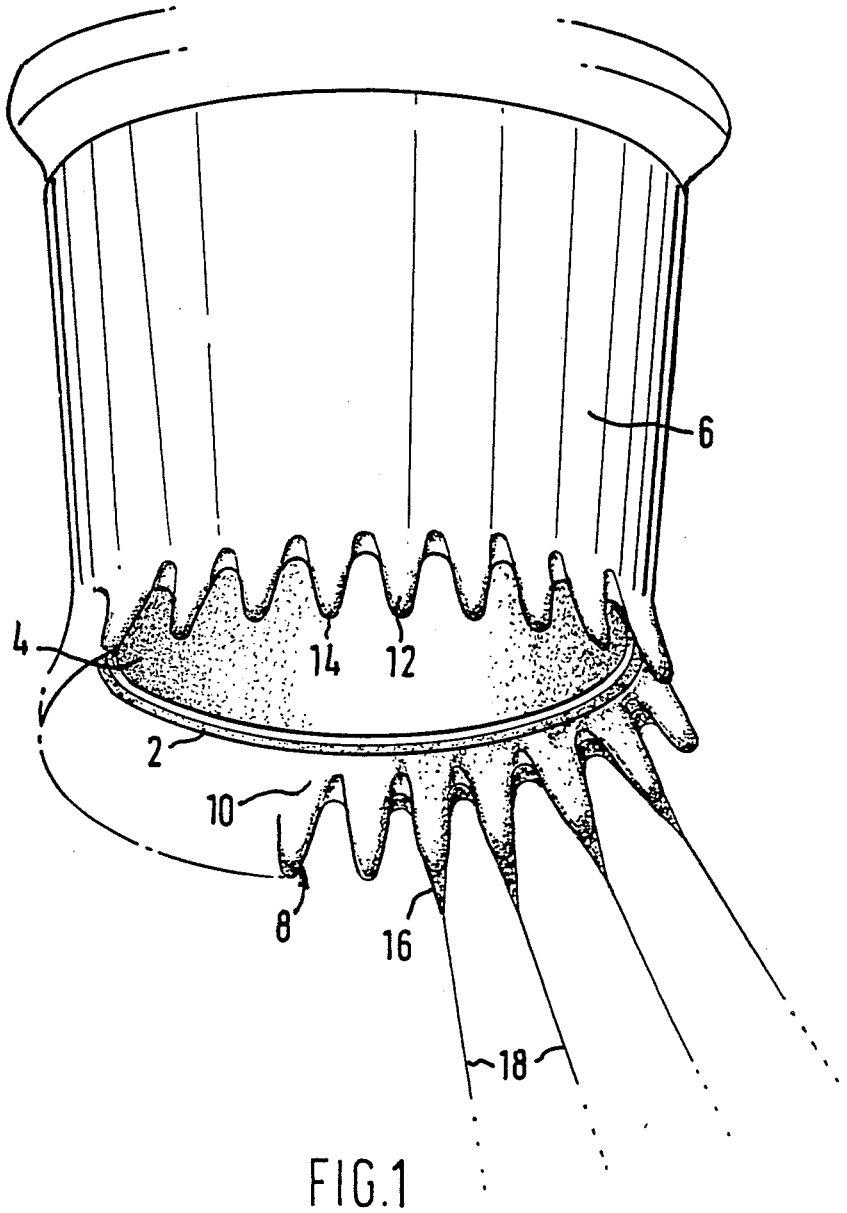
FIG. 1 shows a spraying nozzle of apparatus embodying the invention.

The nozzle illustrated has an annular orifice 2 defined between an inner generally cylindrical member 4 and a generally cylindrical outer member 6. The outer member 6 extends beyond the inner member 4, to an edge 8. Liquid to be sprayed is fed, say by gravity, downwards between the inner and outer members 4 and 6 to the orifice 2. Liquid emerging from the orifice 2 runs down the inside of the outer member 6 to the edge 8.

The outer member 6 is electrically conductive or semiconductive. Examples of suitably conductive materials are metals, and conductive plastics. In this example, the edge 8 is thus formed actually in the conducting or semiconducting surface 10 via which the liquid to be sprayed is delivered to the edge 8. In another example to be described later, the edge and the surface are separate.

In use the outer member 6 is connected to an output terminal 7 of a high voltage generator 9. It is generally known that when high potential electrodes are of positive polarity, corona onset is slightly less likely to occur. It is therefore preferred to connect the positive output of the high voltage generator to the outer member 6, although it is practical to use a negative polarity if this had other advantages. A terminal 11 of the generator, which is common to its input and its output, is effectively connected to earth, or in any event the target to be sprayed, so as to establish an electric field between the edge 8 and the target.

A battery 13 is connected via an on/off switch 15, between the common terminal 13 and a low voltage input terminal 17 of the generator, so that when the switch 15 is closed, a high voltage of from 25 to 35 Kv is produced at the terminal 7, to charge the outer member 6 relative to earth and/or the target.

The edge 8 is shaped to provide local intensification of the field at a plurality of spaced sites. To this end, the edge 8 is formed with a plurality of spaced teeth 12. Although if the high voltage is applied to conducting teeth before the liquid is supplied, the tips define an intense electric field, in use the tips do not define the field directly. In use, liquid flows down the teeth to cover the tips thereof. This can be under the influence of gravity and/or electrostatic forces. The liquid, which must be to some degree conducting, essentially defines the high potential boundary of the electric field. The teeth 12 are sufficiently sharp, that the field strength at the liquid/air boundary at the tips 14 of the teeth, is great enough to draw out a cone 16 of the liquid at the voltage produced by the high voltage generator.

The liquid at the tip becomes charged, negative charge being conducted away by the conducting surface 10, leaving a net positive charge on the liquid. The charge on the liquid produces internal repulsive electrostatic forces which overcome the surface tension of the liquid forming a cone 16 of liquid from the tip of which issues a ligament 18. At a distance from the tip 14, the mechanical forces produced on the ligament due to travelling through the air cause it to break up into charged droplets of closely similar size.

Since the teeth are formed of conductive material, a relatively high resistivity liquid can be tolerated. If the resistivity of the liquid is too high, however, it becomes so difficult to ionise that the breakdown potential of air is exceeded before ionisation of the liquid is achieved.

Since the teeth are formed of conductive material, there is a danger that corona discharge will be produced if the field strength is too high. This would be undesirable because it would introduce a requirement for a higher current from the high voltage generator, increasing the cost thereof and reducing the life of any batteries used to power it.

To prevent corona in use, the teeth are made with no very small corner radii. The minimum corner radius at the tips may be sufficiently large that corona will not occur, in use, or rather before use, even when the tips are not covered by the liquid. Alternatively, it may be possible to use a smaller minimum corner radius, if the radius is still large enough to be wetted by the liquid to be sprayed, and care is taken to supply the liquid to the tips, so as to wet the tips, before the high voltage is switched on. The larger radius produced by the covering liquid, together with the increased resistivity, which lowers the potential of the high voltage boundary of the electric field, both contribute to a reduction in the likelihood of corona.

Whether the minimum radius that can be wetted is smaller than the minimum radius that will avoid corona "dry", depends on the surface tension of the liquid and on the high voltage produced by the generator. The lower the surface tension, the smaller is the minimum corner radius that can be wetted. The lower the high voltage produced by the generator, the smaller the minimum corner radius without producing corona. So, the lower the surface tension and the lower the voltage, the less likely it is that the liquid will wet a smaller corner radius than will avoid corona.

We have found it quite possible to make teeth which are sufficiently sharp to spray and yet not so sharp as to cause corona in use at the voltage provided by the high voltage generator, e.g. 25 to 35 Kv. It is expected that a minimum corner radius at the tip of 100 to 200 microns would not produce corona, in use, at about 30 Kv.

The teeth provide a local intensification of the electric field at their tips which is sufficient to spray, forming a ligament at each tip, over a wide range of voltages and distances from the target. In one implementation, one ligament can be obtained off each tip over the range 25 to 35 Kv. The number of ligaments was found virtually independent of the distance from the target in this voltage range. The droplet size is therefore largely independent of voltage over a wide range which reduces the need to regulate the voltage output of the generator. The droplet size is also adequately independent of the distance from the target.

The teeth 12 are splayed outwardly in order to increase the swath width of the spray. The teeth might be straight or turned inwardly if narrower swath widths were required.

In another alternative, the nozzle could be configured so that the orifice is a linear slot the spraying edge 8 being generally linear.

In yet another alternative, the teeth are formed in a more insulating material. A highly insulating plastics material might be for example PTFE. A less insulating material e.g. formaldehyde paper composite such as that sold under the trade name "Kite Brand" by Tufnol could also be used. This reduces the tendency to corona so that the teeth can be much sharper than the brass teeth illustrated.

With insulating teeth, the liquid is still delivered to the edge 8 via a conducting or semiconducting surface. However, this is upstream of the edge 8. The electric field is defined by the liquid arriving at the edge 8. Negative charge is be conducted away from the liquid at its contact with the conducting surface, leaving a net positive charge on the liquid.

We find it necessary to dimension the spacing of the edge 8 from the conducting or semiconducting surface suitably, in relation to the resistivity of the liquid being sprayed. We find that spraying will not take place if, given a spacing, the resistivity of the liquid is too high or, conversely, given a particular resistivity, the spacing is too great. A possible explanation for this observation is that in addition to the liquid becoming charged as it passes over the conducting or semiconducting surface, there is also conduction of charge away from the liquid at a tip 14 through the liquid. The resistance of this path must not be so high that the voltage drop across it results in the voltage at the tips 14 being too low to produce an atomising field strength. The distance between the edge 8 and the conducting or semiconducting surface must therefore be sufficiently small to allow for the resistivity of the liquid being used. We have found that a suitable position can be found for the surface even when spraying, say, a pesticide having a resistivity in the range $10^6$ to $10^{10}$ ohm cm.

The result of the conduction through the liquid is that there is a voltage gradient along the teeth, i.e. in the direction of liquid flow. The resulting electric field produces a force parallel to the surface, sometimes called a tangential force, which acts to propel the liquid along from the orifice 2 along the teeth towards their tips. In the case of conducting teeth, there is no significant voltage gradient and it is more difficult to deliver the liquid along the teeth to the tips.

In the arrangement illustrated the teeth if made of insulating material could be much sharper and the conducting or semiconducting surface could be provided by making the inner member 4 of suitable material. A non-conducting edge could be provided by a ring pressed on a conducting outer member 6. Alternatively, the outer 6 could be nonconducting and the inner 4 could be conducting. In that arrangement it is not so easy to apply the high voltage to the surface, i.e. the inner. In yet another alternative, the teeth are provided on a non conducting inner and the outer is conducting. The liquid then flows down the outside of the teeth to the tips. Care has to be taken in the design of the outer that the liquid does not spray off the edge at the end thereof.

One of the factors which influences the size of the droplets, is the flow rate. If all other factors are constant, increasing the flow rate increases the droplet size. The nozzle and container illustrated in FIGS. 2 and 3 is sectioned to show an arrangement for controlling the flow.

In the arrangement shown three different parameters are used to control the flow rate.

One of the parameters is the size of the passages through which the liquid flows. The size is determined accurately by providing the outer 6 with internal ribs 20 (see FIG. 3). The inner 4 is a press fit to the ribs 20, so that passages 22 for the fluid are defined between the ribs. The passages open into a complete annular orifice 2 at their lower ends. The passages can be more accurately manufactured than it would be convenient to make a continuous annular passage. The dimensions and the number of the passages 22 partly control the flow rate. Smaller cross section, longer lengths and fewer passages would all contribute to lower flow rate.

In the arrangement illustrated, a container 4 is sealed to the spray nozzle 26. The container has has no means of pressure relief except via an air bleed screw 28. As can be seen the inner 4 is hollow and extends into the container 24. The air bleed screw 28 is threadedly engaged in the inner end of the inner 4.

The second parameter affecting flow rate is the dimensions of the helical passage provided round the thread of the air bleed screw partly determine the rate at which pressure in the container is relieved to allow liquid to flow out. Longer helical passage and smaller cross section both contribute to lower flow rate.

The third parameter affecting the flow rate, is the height of the air bleed screw 28 above the orifice 2 which with the control provided by the air bleed screw, determines the head of liquid above the orifice. The smaller the distance the air bleed screw is above the orifice the smaller the flow rate.

The outer 6, which is again conductive or semiconductive, is provided with an external screw thread 30. This is received, in use, by an internal thread 32 in a holder 34 mounted at one end of an insulating lance 36, only one end of which is shown in the drawing. At its other end, the lance carries the high voltage generator 9 and battery 13. The earth connection may be made by a trailing wire or suitably conductive cord. The output terminal of the high voltage generator 9 is connected via a lead 38 within the lance, to a contact 40 so positioned within the holder 34 as to contact the outer 6 when this is screwed into the holder.

As will be appreciated, the combination of an insulating lance and an earth wire trailing from the end of the lance opposite the nozzle, results in the nozzle being free from any low potential influences from the apparatus. The long path via the lance between the nozzle and the trailing earth wire reduces leakage to earth from the nozzle. This both increases battery life and reduces the current rating of the high voltage generator.

Figure 6:
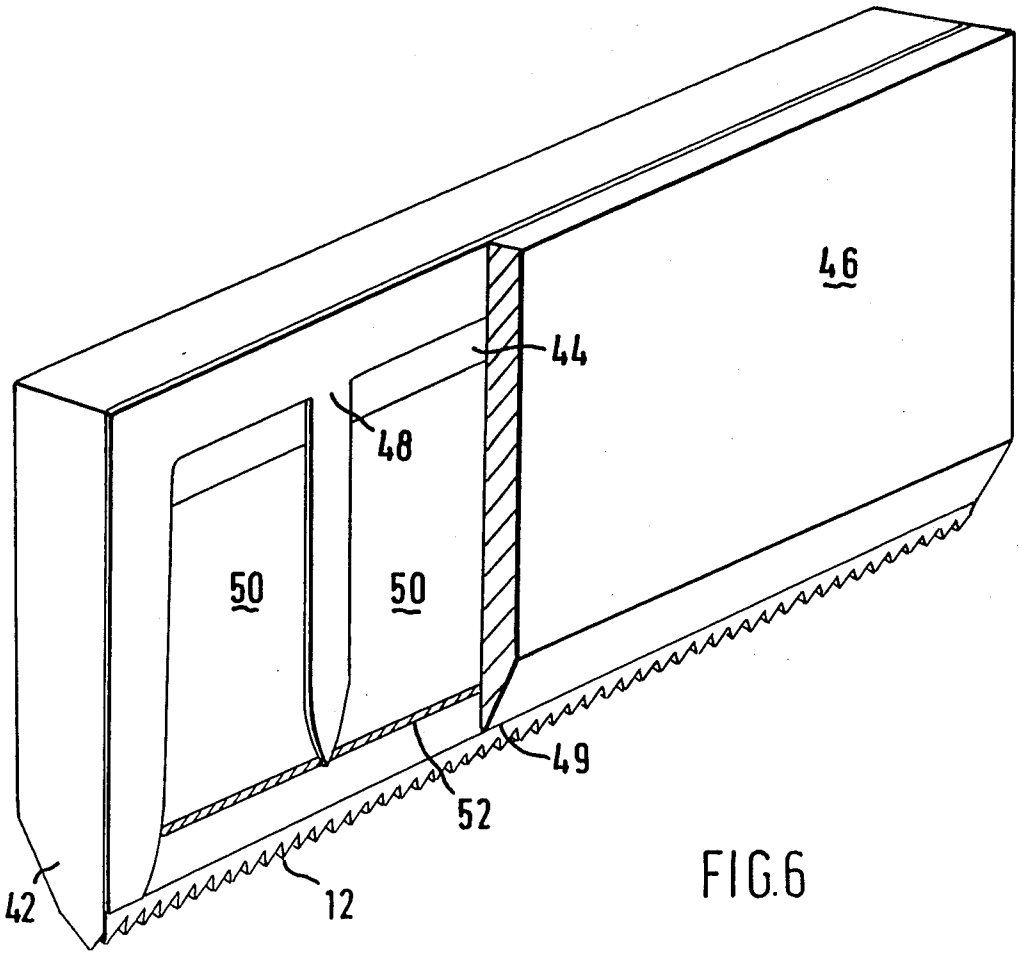
FIG. 6 is a partly broken perspective view of a linear nozzle of apparatus embodying the invention.

FIG. 6 illustrates another embodiment of the invention. Instead of the nozzle having a ring of teeth, illustrated in the previous embodiment, in FIG. 6 the teeth 12 are provided in a straight row. The teeth 12 are formed in a body member 42 of insulating plastics material. Liquid to be sprayed is provided via an inlet (not illustrated) to a liquid distribution gallery 44 in the body 42. A closing plate 46 is spaced from and sealed to the body member 42 by a gasket 48. The gasket is open sided adjacent the teeth 12 defining a linear slot 49 between the body member 42 and the closing plate 46. The gasket is so shaped as to provide channels 50 to supply liquid from the distribution gallery 44 to the slot 49. Upstream from the mouth of the slot 49, a conducting or semiconducting strip 52 is inset into the body member 42 to provide a liquid contacting surface. The strip 52 is connected to a high voltage output of a high voltage supply (not shown in FIG. 6) to charge the liquid so that spraying takes place, one ligament being formed per tooth, as described previously. Again, sufficient electrical field strength is obtained at the tips of the teeth, without the apparatus having any parts at low potential near the nozzle. The field strength is defined substantially independent of any low potential influences from the apparatus.

The nozzle shown in FIG. 7 is in the form of a bath 54 made from an insulating plastics material, having teeth 12 formed along one edge 56. Grooves 57 in the base of the bath communicated with the tip of each tooth 12. In use the bath is filled with liquid 58 to be sprayed, to a level close to the edge 56. The level may be maintained by providing a continuous supply of liquid and allowing excess to return via an overflow (not shown) to be recycled. A conducting surface is provided in the embodiment illustrated by a wire 60 which in use is connected to the high voltage output 7 of the supply 9. Application of a high voltage to the wire 60 charges the liquid 58 and the resulting electric field propels it towards the teeth 12. When the liquid covers the teeth 12 the field strength at the tips of the teeth is sufficiently intense that the liquid is sprayed off as ligaments which break up into droplets as previously described. This embodiment has the advantage that it does not drip if spraying is halted by the interruption of the high voltage supply, although due to the open nature of the bath, it would not be suitable for applications where is is required to move the nozzle e.g. by hand, as when spraying an insecticide on a plant.

As before the nozzle is used without any substantial earth influences from the apparatus. Sufficient electric field strength is obtained at the tips of the teeth, without the provision of low potential parts or electrodes close to the nozzle.

We claim:

1. Electrostatic spraying apparatus, comprising: a nozzle having a spraying edge (8), an electrically conducting or semiconducting liquid contacting surface (10) and means (22) for delivering liquid to be sprayed to the edge (8); and high voltage supply means (9) for charging the surface (10) to a high potential, characterised by the edge (8) being so shaped at a plurality of sites (14) that, in use, when covered by the liquid to be sprayed, the local electric field strength is intensified sufficiently, at the voltage produced by the high voltage supply means (9), that the liquid at the sites (14) is drawn out preponderantly by electrostatic forces into ligaments (18) which break up into electrically charged particles; the edge (8) between said sites (14) being so shaped that, in use, the local electric field strength is relatively less intense; and the nozzle being so positioned in said apparatus that, in use, the said electric field strength is defined substantially independent of any low potential influences from rest of the apparatus.

2. Apparatus as claimed in claim 1, wherein the edge (8) is shaped at said sites (14) to provide sharp tips formed in material sufficiently insulating to prevent corona discharge, in use, at the voltage produced by the high voltage supply means, said surface being upstream of the edge.

3. Apparatus as claimed in claim 1, wherein the edge (8) is shaped at said sites (14) to provide tips formed in conducting or semiconducting material, and insufficiently sharp to produce a corona discharge, in use, at the voltage produced by the high voltage supply means.

4. Apparatus as claimed in claim 2 or claim 3, wherein the edge (8) has the form of a tooth at each site (14).

5. Apparatus as claimed in claims 1, 2 or 3, wherein the edge (8) is generally circular.

6. Apparatus as claimed in any of claims 1, 2 or 3, wherein the spraying edge is generally linear.

* * * * *